US008006881B2

(12) United States Patent
Arata et al.

(10) Patent No.: US 8,006,881 B2
(45) Date of Patent: Aug. 30, 2011

(54) MAGAZINES IN FASTENER DRIVING TOOLS

(75) Inventors: Ken Arata, Anjo (JP); Yasuhiro Morioka, Anjo (JP); Jiro Oda, Anjo (JP); Noriyuki Nishido, Anjo (JP); Ken Shibahara, Anjo (JP)

(73) Assignee: Makita Corporation, Anjo-Shi (JP)

( * ) Notice: Subject to any disclaimer, the term of this patent is extended or adjusted under 35 U.S.C. 154(b) by 160 days.

(21) Appl. No.: 12/320,968

(22) Filed: Feb. 10, 2009

(65) Prior Publication Data

US 2009/0200354 A1 Aug. 13, 2009

(30) Foreign Application Priority Data

Feb. 13, 2008 (JP) ..... 2008-031591

(51) Int. Cl.
*B25C 1/18* (2006.01)

(52) U.S. Cl. ..... 227/120; 227/125

(58) Field of Classification Search ..... 227/8, 9, 227/10, 103, 119, 120, 121, 123, 125, 126, 227/130, 135, 136
See application file for complete search history.

(56) References Cited

U.S. PATENT DOCUMENTS

| | | | | |
|---|---|---|---|---|
| 3,266,697 | A * | 8/1966 | Fiedler | 227/120 |
| 3,615,049 | A * | 10/1971 | Obergfell et al. | 227/28 |
| 4,463,888 | A * | 8/1984 | Geist et al. | 227/109 |
| 4,524,896 | A * | 6/1985 | Morrell, Jr. | 227/126 |
| 4,815,647 | A * | 3/1989 | Chou | 227/109 |
| 5,433,367 | A * | 7/1995 | Liu | 227/120 |
| 5,588,577 | A * | 12/1996 | Chen | 227/120 |
| 5,813,588 | A * | 9/1998 | Lin | 227/109 |
| 5,975,399 | A * | 11/1999 | Oehri et al. | 227/120 |
| 6,056,181 | A * | 5/2000 | Chuang | 227/8 |
| 6,179,192 | B1 * | 1/2001 | Weinger et al. | 227/8 |
| 6,641,019 | B2 * | 11/2003 | Hadfield | 227/109 |
| 6,938,809 | B1 * | 9/2005 | Schnell | 227/8 |
| 7,299,959 | B2 * | 11/2007 | Ishizawa et al. | 227/120 |
| 7,513,403 | B2 * | 4/2009 | Fujimoto | 227/8 |
| 7,549,562 | B2 * | 6/2009 | Wu et al. | 227/120 |
| 2006/0249554 | A1 * | 11/2006 | Butzen et al. | 227/130 |
| 2007/0138229 | A1 * | 6/2007 | Fujimoto | 227/8 |

FOREIGN PATENT DOCUMENTS

JP A-2000-15589 1/2000

* cited by examiner

*Primary Examiner* — Paul Durand
(74) *Attorney, Agent, or Firm* — Oliff & Berridge, PLC

(57) ABSTRACT

A magazine in a fastener driving tool includes a magazine body, a pusher, a biasing device and a pusher holding device. The magazine body defines a fastener receiving space for storing a plurality of fasteners therein. The pusher is mounted to the magazine body and is movable in a fastener feeding direction toward a fastener driving channel defined in a tool body of the fastener driving tool. The biasing device biases the pusher in the fastener feeding direction. The pusher holding device can hold the pusher at a midway position within a movable range of the pusher in the fastener feeding direction. The pusher holding device may include no insertion hole or only one insertion hole formed in the magazine body.

20 Claims, 10 Drawing Sheets

MAGAZINES IN FASTENER DRIVING TOOLS

This application claims priority to Japanese patent application serial number 2008-031591, the contents of which are incorporated herein by reference.

BACKGROUND OF THE INVENTION

1. Field of the Invention

The present invention relates to magazines for storing a plurality of fasteners in fastener driving tools, such as nailers.

2. Description of the Related Art

Known fastener driving tools include a tool body having a piston disposed therein. The piston is reciprocally driven by a drive source, such as a compressed air. A driver guide defining a fastener driving channel therein is mounted to a lower end of the tool body. A front end with respect to a feeding direction of a magazine is connected to the driver guide. A plurality of fasteners are stored within the magazine. In general, the fasteners are joined in series and in parallel with each other to form a thin plate-like fastener stick (hereinafter called "fastener stick"). Each of the fasteners in the fastener stick can be separated from the other as it is driven by a driver that is coupled to the piston and is reciprocally moved within the fastener driving channel.

The fastener stick is biased in a feeding direction toward the fastener feeding channel by a pusher that is biased, for example, by a coil spring. If one of the fasteners of the fastener stick is driven out of the fastener feeding channel, the pusher moves the fastener stick toward the fastener feeding channel by a distance corresponding to a thickness of each of the fasteners (i.e., a distance corresponding to a pitch of the fasteners in the fastener stick), so that the fastener positioned next to the driven fastener is fed into the fastener feeding channel.

In general, in order to facilitate the operation for inserting a fastener stick into the magazine, a lock device is provided for fixing the pusher in position when the pusher has moved to its rear stroke end opposite to the feeding direction.

In the case of the fastener driving tool having the magazine configured as described above, when one of the fasteners has been clogged within the driver guide, it is possible to remove such a logged fastener by moving the stored fastener stick in a direction opposite to the feeding direction, removing the fastener stick from the magazine, or moving the pusher in a direction opposite to the feeding direction.

However, in the case that the pusher is moved in the direction opposite to the feeding direction for removing the clogged fastener, a relatively large force is necessary to be applied to the pusher for moving the pusher to the rear stroke end, where the pusher is locked, against a basing force of the coil spring. Because this operation is troublesome in some occasion, Japanese Laid-Open Patent Publication No. 2000-15589 (Japanese Patent No. 3524387) has proposed to form insertion holes in a magazine body at a midway position within a stroke of movement of the pusher and to insert a stopper pin into and through the insertion holes. Therefore, the stopper pin can prevent the pusher from moving in the fastener feeding direction beyond the stopper pin. With this arrangement, it is possible to hold the pusher at a position away from the fastener driving channel by a distance enough to enable the operation for removing the clogged fastener from the fastener driving channel.

However, according to the technique of Japanese Patent Laid-Open Patent Publication No. 2000-15589, it is necessary to insert the stopper pin into the insertion holes formed in opposite sides of the magazine body so as to extend across the fastener receiving space.

Therefore, there is a need for magazines in fastener driving tools, which have a pusher holding device that can hold a pusher in a midway position and has a simply configured magazine body.

SUMMARY OF THE INVENTION

One aspect according to the present invention includes magazines in fastener driving tools. The magazines include a magazine body, a pusher, a biasing device and a pusher holding device. The magazine body defines a fastener receiving space for storing a plurality of fasteners therein. The pusher is mounted to the magazine body and is movable in a fattener feeding direction toward a fastener driving channel defined in a tool body of the fastener driving tool. The biasing device biases the pusher in the fastener feeding direction. The pusher holding device can hold the pusher at a midway position within a movable range of the pusher in the fastener feeding direction. The pusher holding device may include no insertion hole or only one insertion hole formed in the magazine body.

DETAILED DESCRIPTION OF THE INVENTION

Each of the additional features and teachings disclosed above and below may be utilized separately or in conjunction with other features and teachings to provide improved magazines for fastener driving tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, the pusher holding device includes an engaging member mounted to one of the magazine body and the pusher and movable between an engaging position and a rest position. The engaging member can engage the other of the magazine body and the pusher for holding the pusher at the midway position against the biasing force of the biasing device.

In another embodiment, the pusher holding device includes an engaging member that can engage the pusher with at least one of a pair of guide rails that serve to guide the fasteners in the fastener feeding direction.

In a further embodiment, the pusher holding device includes an insertion hole formed in the pusher, an engaging member that can be removably inserted into the insertion hole, and an engaging portion provided on the magazine body or a part of the tool body, so that the engaging member can engage the engaging portion.

In a further embodiment, the magazine includes a leaf spring having a first end portion connected to the magazine body and a second end portion opposite to the first end. A winding wheel is rotatably supported on a support wall of the pusher. The second end portion of the leaf spring is connected to the winding wheel and is spirally wound around the winding wheel, so that the pusher is biased in the fastener feeding direction by the leaf spring. The pusher holding device is configured to releasably fix the rotational position of a winding wheel relative to a support wall of the pusher.

Figure 1:
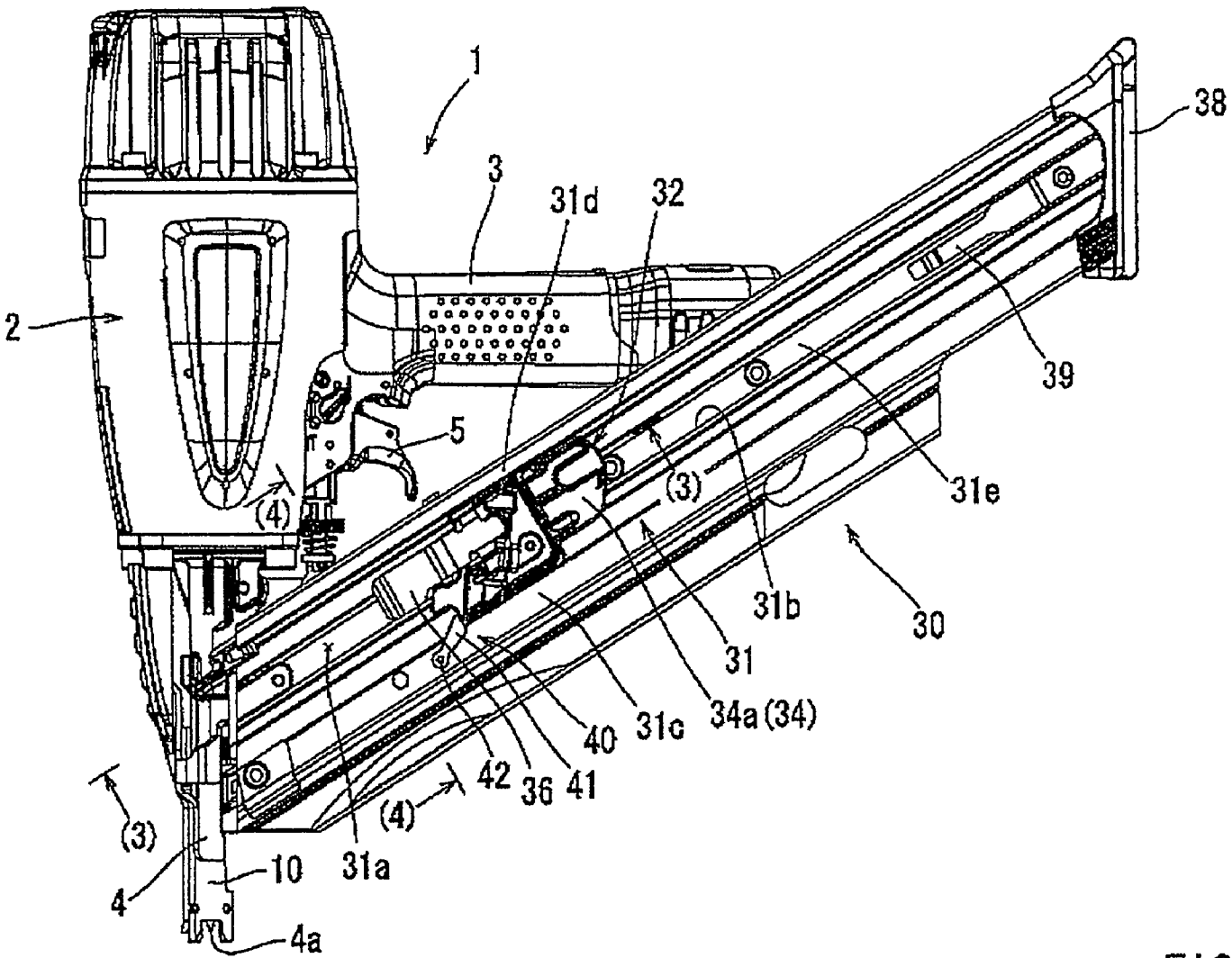
FIG. 1 is a side view of a fastener driving device according a first embodiment of the present invention.

A first embodiment according to the present invention will now be described with reference to FIGS. 1 to 4. Referring to FIG. 1, a fastener driving tool 1 incorporating a magazine 30 according to the first embodiment. The fastener driving tool 1 has a tool body 2 having a piston (not shown) disposed therein. The piston is vertically reciprocally moved by the pressure of a compression air that serves as a drive source. A driver guide 4 is mounted to the lower end of the tool body 2 and extends vertically downward therefrom. The driver guide 4 has a lower end with an outlet 4*a*, from which fasteners n (see FIG. 3) can be driven out. A driver (not shown) is connected to the piston and can reciprocally move within a fastener driving channel 4*b* formed within the driver guide 4, so that the driver can apply an impact force to one of the fasteners n positioned within the driver guide 4 for driving the one of the fasteners n out of the outlet 4*a*.

A handle 3 extends laterally from a side portion of the tool body 2, so that an operator can grasp the handle 3 for operating the fastener driving tool 1. A trigger or a switch lever 5 is mounted to the tool body 2 at a position below the base portion of the handle 3, so that the operator can pull the switch lever 5 by fingers of his or her hand that grasps the handle 3. The switch lever 5 is coupled to a control device (not shown) that can control the compressed air such that the compressed air may cause the piston to reciprocate vertically by one stroke within the tool body 2 when the operator pulls the switch lever 5. Therefore, the driver also reciprocates vertically within the driver guide 4 by one stroke. As the driver moves downward, the driver applies an impact onto one of the fasteners n positioned within the driver guide 4, so that one of the fasteners n is forcibly removed from the other fasteners n and is then driven out of the outlet 4*a*. The fasteners n can be driven out of the driver guide 4 one by one as the operator repeatedly pulls and releases the switch lever 5. The control device will not be described in detail, because such a control device for controlling a compressed air to enable reciprocating movement of the piston is known in the art.

A magazine 30 is mounted to extend between the handle 3 and the driver guide 4 and includes a magazine body 31 and a pusher 32. A fastener stick N is stored within the magazine body 31. The fastener stick N consists of a plurality of parallel fasteners n that are joined in series with each other. For example, the fasteners n may be nails. The fastener stick N has a thin plate-like configuration and may be also called a "sheet fastener." The pusher 32 is supported on the magazine body 31 such that the pusher 32 can move in the lengthwise direction along the magazine body 31. The pusher 32 serves to push the fastener stick N in a fastener feeding direction P toward the fastener driving channel 4*b* of the driver guide 4.

In this specification, the fastener feeding direction P is parallel to the longitudinal direction of the magazine body 31. A direction that is perpendicular to the fastener feeding direction P is called a "fastener height direction (or fastener height direction) L" of the fasteners n. In this embodiment, the fastener height direction L is parallel to a widthwise direction of the magazine body 31. A direction perpendicular to both of the fastener feeding direction P and the fastener height direction L is called a "fastener thickness direction D." In addition, in this specification, the terms "a front side" or "a forward direction", and "a rear side" or "a rearward direction", "a right side" or "a rightward direction" and "a left side" or "a leftward direction" are used to mean the sides or directions with respect to the fastener feeding direction P. Therefore, the fastener height direction L corresponds to the upward or downward direction.

Figure 4:
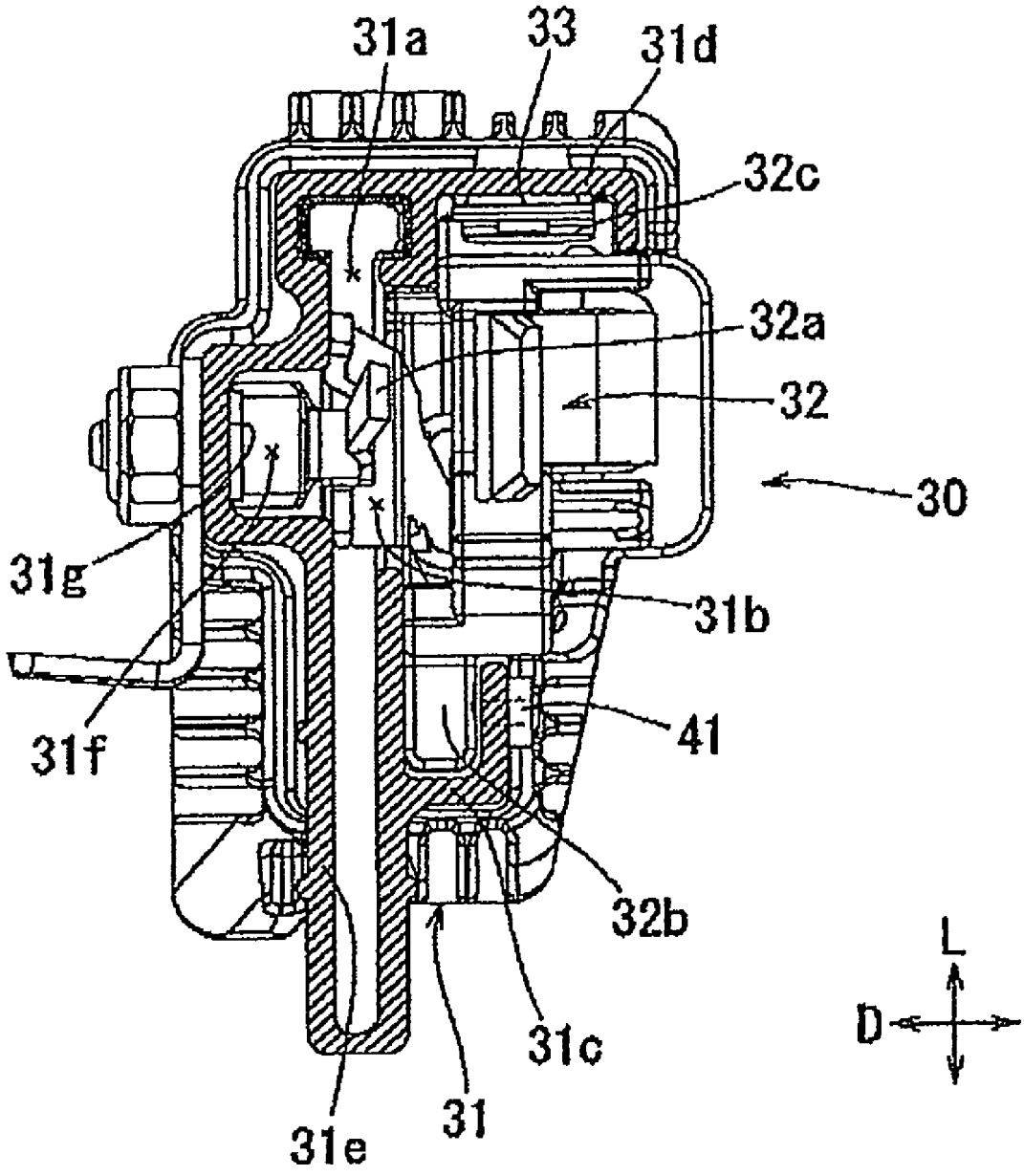
FIG. 4 is a cross sectional view taken along line (4)-(4) in FIG. 1

A fastener receiving space 31*a* for receiving the fastener stick N is defined within the magazine body 31 along its entire length. As shown in FIG. 4, the fastener receiving space 31*a* has a cross sectional configuration that substantially corresponds to the cross sectional configuration of the fastener stick N. An opening 31*b* is formed in a left side wall (right side wall as viewed in FIG. 4) of the magazine body 31 defining the fastener receiving space 31*a* The opening 31*b* extends along the entire length of the left side wall and has a uniform width in the fastener height direction L. The pusher 32 has a feeding claw 32*a* that enters the fastener receiving space 31*a* via the opening 31*b*.

A fastener guide surface 31*e* is formed on a right side wall opposed to the left side wall of the fastener receiving space 31*a* and serves to guide the fastener stick N.

The fastener feeding claw 32*a* is pivotally mounted to the pusher 32 via a support shaft (not shown) such that the fastener feeding claw 32*a* can move between a first position, where a free end of the fastener feeding claw 32*a* is positioned within the fastener receiving space 31*a*, and a second position, where the fastener feeding claw 32*a* is positioned out of the fastener receiving space 31*a*. As the fastener stick N is inserted into the fastener receiving space 31*c*, the fastener feeding claw 32*a* is pushed by the fastener stick N so as to be moved out of the fastener receiving space 31*a*. Therefore, the fastener stick N can move from a position on the rear side of the pusher 32 to the front side of the pusher 32 along the fastener feeding direction P (from the right side to the left side as viewed in FIG. 1). When all of the fasteners n (i.e., the entire fastener stick N) have moved to the position on the front side of the pusher 32, the fastener feeding claw 32*a* returns to enter the fastener receiving space 31*a* and engages the rear end of the fastener stick N, so that the pusher 32 forces the fastener stick N forwardly in the fastener feeding direction P toward the fastener driving channel 4*b* of the driver guide 4.

Figure 3:
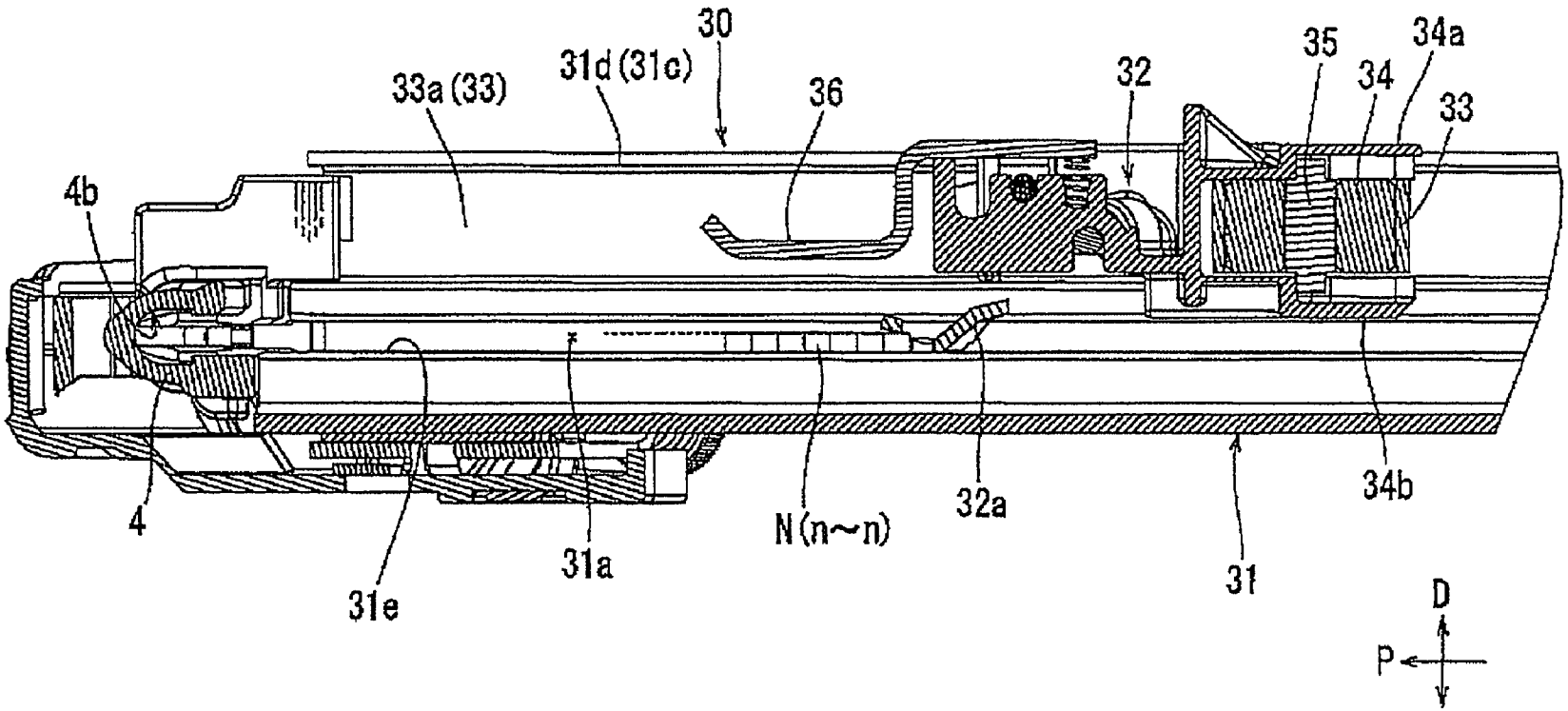
FIG. 3 is a cross sectional view taken along line (3)-(3) in FIG. 1.

The pusher 32 has a pair guide portions 32*b* and 32*c* on opposite sides with respect to the fastener height direction L (upper and lower sides as viewed in FIG. 4). The guide portions 32*b* and 32*c* are slidably received by guide rails 31*c* and 31*d* provided on opposite sides with respect to the fastener height direction L (upper and lower sides as viewed in FIG. 4) of the magazine body 31. Therefore, the pusher 32 can move in the fastener feeding direction P and in the direction opposite thereto under the guide of the guide rails 31*c* and 31*d*. A spiral or coiled leaf spring 33 normally biases the pusher 32 in the fastener feeding direction P (i.e., toward the fastener driving channel 4*b* of the driver guide 4). As shown in FIG. 3, the leaf spring 33 is wound around a cylindrical winding wheel 34 disposed at the rear portion (right side portion as viewed in FIG. 3) of the pusher 32. An unwinding side end portion 33*a* of the leaf spring 33 is secured to the front end portion of the magazine body 31.

The winding wheel 34 is supported between a pair of support wall portions 34*a* and 34*b* formed on the rear portion of the pusher 32. More specifically, the support wall portions 34*a* and 34*b* extend parallel to each other and are spaced by a predetermined distance in the fastener thickness direction D. A support shaft 35 extends between the wall portions 34*a* and 34*b* and rotatably supports the winding wheel 34.

An engaging lever 36 is mounted to the right side portion (upper portion as viewed in FIG. 3) of the pusher 32. When the number of the fasteners n of the fastener stick N remaining within the fastener receiving space 31*a* has been reduced to zero or a predetermined number, the pusher 32 is positioned to be proximate to the fastener driving channel 4*b* of the driver guide 4, so that the engaging lever 36 may engage a contact lever 10 (see FIG. 1) that is vertically slidably mounted to the driver guide 4. Therefore, the contact lever 10 is prevented from moving along the driver guide 4, resulting in that the switch lever 5 is prevented from being pulled by the fingers of the operator. In other words, the pulling operation of the switch lever 5 becomes ineffective. As a result, an idle driving operation of the fasteners n can be prevented.

As shown in FIG. 1, a cap 38 having a fastener inlet opening is mounted to the rear end of the magazine body 31, so that the fastener stick N can be inserted into the fastener receiving space 31*a* via the fastener inlet opening of the cap 38. In addition, a retainer arm 39 is mounted to the cap 38 and serves to prevent the inserted fastener stick N from being removed from the fastener receiving space 31*a*. In this embodiment, the retainer arm 39 is constituted by a leaf spring.

As the fastener stick N is inserted into the fastener receiving space 31*a*, the fastener stick N causes the retainer arm 39 to be resiliently deformed, so that the fastener stick N can be inserted further into the fastener receiving space 31*a*. After the fastener stick N has been completely inserted into the fastener receiving space 31*a*, the retainer arm 39 restores its original configuration and engages the rear end of the fastener stick N, so that the fastener stick N can be prevented from being removed from the fastener receiving space 31*a*.

Figure 2:
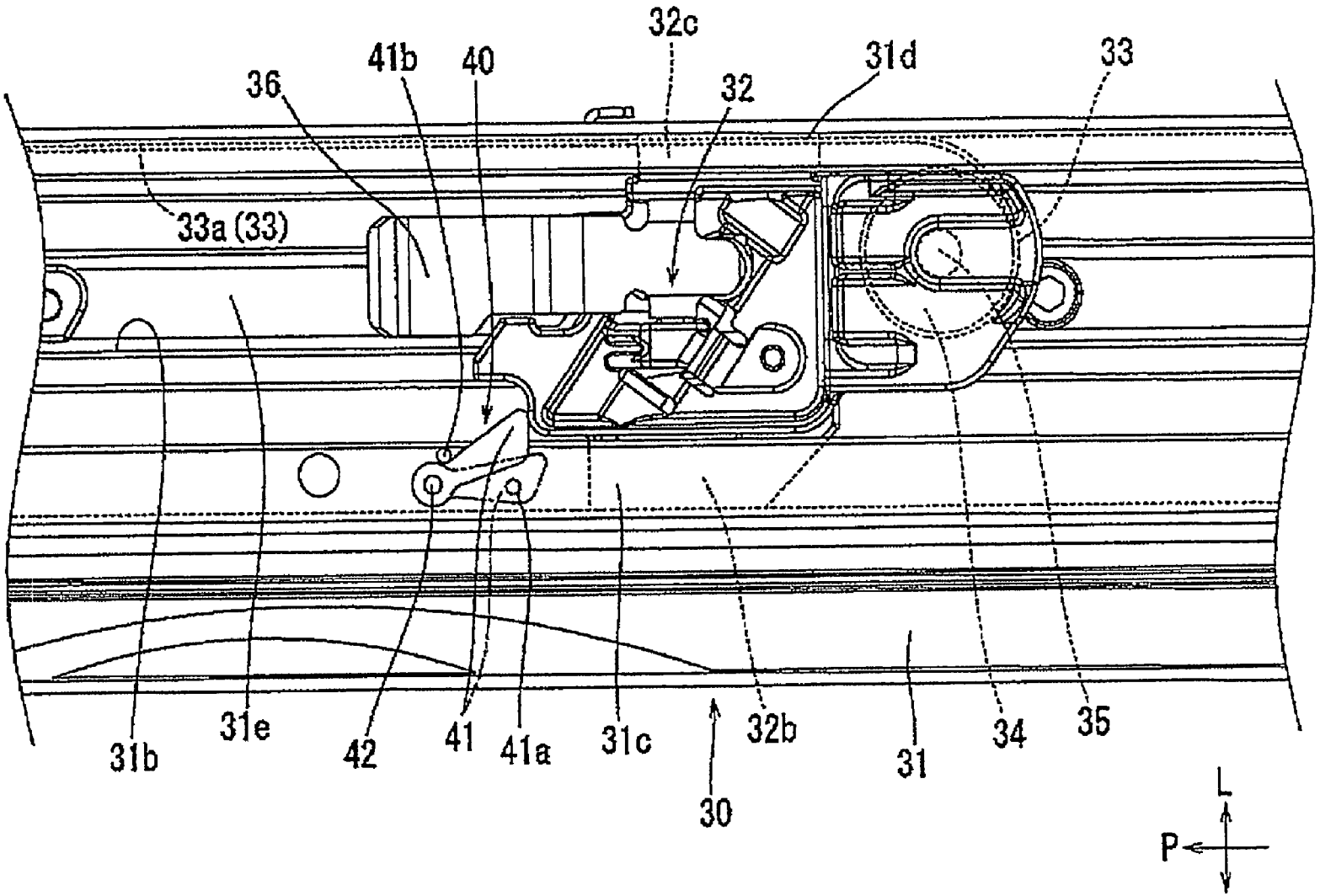
FIG. 2 is an enlarged side view of a part of a magazine of the fastener driving device and showing a pusher holding device and its associated components.

In this embodiment, a pusher holding mechanism 40 is provided in order to hold the pusher 32 at a midway position along its movable range in the fastener feeding direction P. In this embodiment, the midway position is set at a midpoint that is spaced equally from a front movable end and a rear movable end of the pusher 32 that may be defined by the leaf spring 33. However, the midway position may be set to be a position proximal to or away from the midpoint as long as a distance that is necessary and sufficient for enabling the fastener(s) n to be easily removed can be ensured. As shown in FIGS. 1 and 2, the pusher holding device 40 includes a stopper 41 that is vertically (in the fastener height direction L) pivotally mounted to a side face of the lower guide rail 31*c* of the magazine body 31 via a support shaft 42. The stopper 41 is positioned at the midway position and is away from the fastener driving channel 4*b* of the driver guide 4, so that the fastener(s) n can be easily removed when the fastener(s) n has been clogged within the fastener driving channel 4*b*.

As indicated by solid lines in FIG. 1, when the stopper 41 has been pivoted upward to an engaging position, the free end of the stopper 41 extends into a path of movement of the pusher 32. When the stopper 41 is in this engaging position, the front end of the pusher 32 contacts the stopper 41 to prevent the pusher 32 from moving fiercer in the fastener feeding direction P. Because the pusher 32 is biased in the fastener feeding direction P by the leaf spring 33, the pusher 32 is fixed at the midway position. Therefore, it is possible to ensure a distance or a space between the pusher 32 and the fastener driving channel 4*b*, which is necessary and sufficient for removing the clogged fastener(s) n from the fastener driving channel 4*b*.

The stopper 41 is normally biased toward the engaging position by a torsion spring (not shown). Therefore, in order to move the stopper 41 from the engaging position (indicated by solid lines in FIGS. 1 and 2) to a rest position (indicated by chain lines in FIG. 2), the operator may manually pivot the stopper 41 against the biasing force of the torsion spring. When the stopper 41 has pivoted to the rest position, a retainer projection 41*a* formed on or mounted to a left side surface of the guide rail 31*c* can engage the stopper 41, so that the stopper 41 can be held at the rest position. The stopper 41 can return from the rest position to the engaging position by the biasing force of the torsion spring when the operator manually forcibly pivots the stopper 41 against the retaining force applied by the retainer projection 41*a* to the stopper 41. The stopper 41 can be held at the engaging position through contact with a stopper projection 41*b* that is formed or mounted to the left side surface of the guide rail 31*c*.

According to the magazine 30 of this embodiment, when it is necessary to remove the clogged fastener n from the fastener driving channel 4*b* of the driver guide 4, it is possible to hold the pusher 32 at the midway position in the fastener feeding direction P, which is not a rearmost position but is spaced away from the fastener driving channel 4*b* by a distance that is necessary and sufficient for removing the clogged fastener n. Therefore, the operator can move the pusher 32 to the midway position by a smaller force than required in the case that it is necessary to move the pusher 32 to its rearmost position against the biasing force of the leaf spring 33. In addition, the pusher 32 can be held at the midway position by holding the stopper 41 at the engaging position through contact with the stopper projection 41*a*. Because the stopper 41 is mounted to the magazine body 31, no separate or independent stopper pin is necessary to be provided. Therefore, there may be no risk of loss of the stopper pin. Hence, the operation for removing the clogged fastener(s) n can be easily rapidly performed.

Further, according to the above embodiment, the stopper 41*a* is mounted to the left side surface of the magazine body 31 and can contact with a part of the pusher 32, which part is positioned away from the fastener feeding claw 32*a* and extends outward from the left side surface of the magazine 30 in the fastener thickness direction D. Therefore, it is possible to prevent the fastener feeding claw 32*a* or a portion proximate thereto from being damaged by the stopper 41*a*.

For example, in the case that an insertion hole is formed in the fastener guide surface 31*e* at a position forwardly of the pusher 32 with respect to the fastener feeding direction P and that a stopper pin is inserted into the insertion hole for preventing the movement of the pusher 32, the feeding claw 32*a* or a portion proximate thereto of the pusher 32 may be pressed against the stopper pin by the biasing force of the leaf spring. In such a case, a possibility may exist that the feeding claw 32*a* or its proximate portion may be damaged or deformed to impair the smooth feeding function. In contrast, according to the pusher holding device 40 of the embodiment, the stopper 41 engages the pusher 32 at a position on the outer side of the magazine body 31. Therefore, it is possible to reliably prevent the feeding claw 32*a* or its proximate portion from being damaged, and hence, it is possible to improve the durability of the magazine 30.

The pusher holding device 40 described above may be modified in various ways. For example, although the torsion spring biases the stopper 41 toward the engaging position in order to hold the stopper 41 at the engaging position, the stopper 41 may be held at the engaging position by a retainer projection that is similar to the retainer projection 41*a*. In addition, although the stopper 41 can pivots between the engaging position and the rest position about the support shaft 42, the stopper 41 may be replaced with a slidable stopper that can slidably move in a direction perpendicular to the feeding direction P between an engaging position and a rest position. Further, in order to hold the pusher 32 at the midway position within the movable range, different mechanisms from that used in the pusher holding device 40 can be incorporated.

Pusher holding devices according to second to thirteenth embodiments will now be described with reference to FIGS. 5 to 16. These embodiments are modifications of the first embodiment. Therefore, in FIGS. 5 to 16, like members are given the same reference numerals as the first embodiment and the description of these members will not be repeated.

Second Embodiment

A second embodiment will now be described with reference to FIG. 5. According to a pusher holding device 50 of this embodiment, a recess 31*f* is formed in the fastener guide surface 31*e* along its entire length along the fastener feeding direction P. An engaging member 51 is attached to a bottom wall 31*g* of the recess 31*f* by means of a sew or a bolt 52 and is positioned at a midway position along the length in the fastener feeding direction P. In this embodiment, the engaging member 51 is constituted by a leaf spring. When no force is applied to the engaging member 51, the engaging member 51 is positioned at a rest position within the recess 31*f* as indicated by solid lines in FIG. 5.

Figure 5:
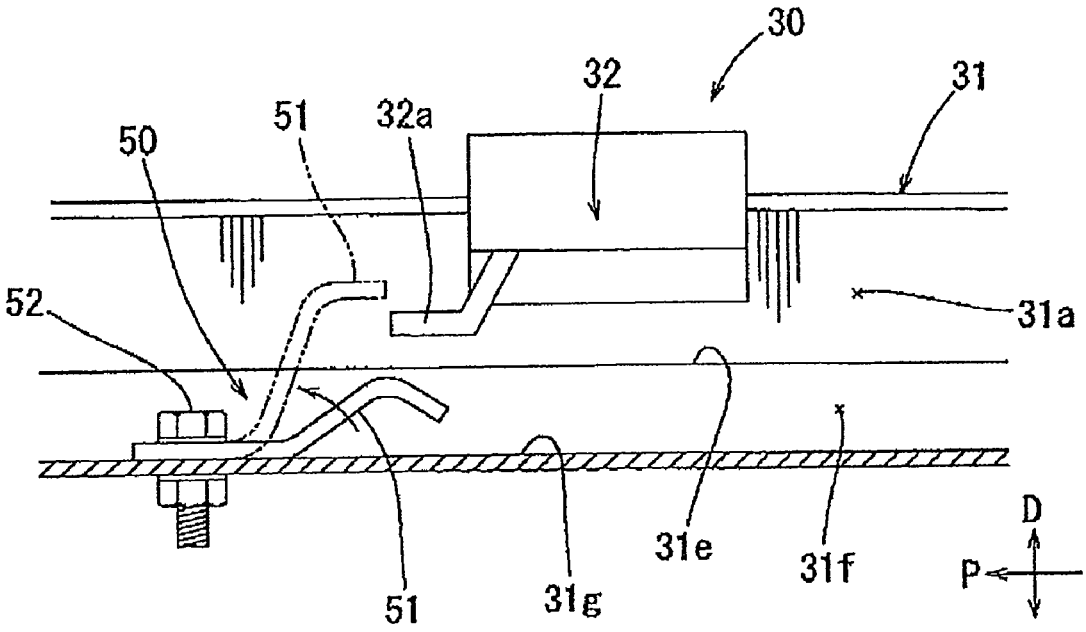
FIG. 5 is a schematic view showing a pusher holding device of a magazine according to a second embodiment of the present invention.

The engaging member 51 can be manually resiliently deformed to be raised to an engaging position where the free end (tipper end as viewed in FIG. 5) of the engaging member 51 extends into the fastener receiving space 31*a* as indicated by chain lines in FIG. 5. When the engaging member 51 is positioned at the engaging position, the feeding claw 32*a* of the pusher 32 can engage the engaging member 51, so that the pusher 32 can be prevented from moving in the fastener feeding direction P. Because the pusher 32 is biased in the fastener feeding direction P by the leaf spring 33, the pusher 32 can be held at the midway position within the movable range of the pusher 32 in the fastener feeding direction P.

Therefore, also with this arrangement, the operation for removing the clogged fastener(s) n within the fastener driving channel 4*b* can be rapidly easily performed. In order to release the pusher 32 from the holding condition, the operator may manually move the pusher 32 in the rearward direction, so that the feeding claw 32*a* is disengaged from the engaging member 51. Then, the engaging member 51 automatically resiliently restores to the rest position after disengagement from the feeding claw 32*a*.

Third Embodiment

Figure 6:
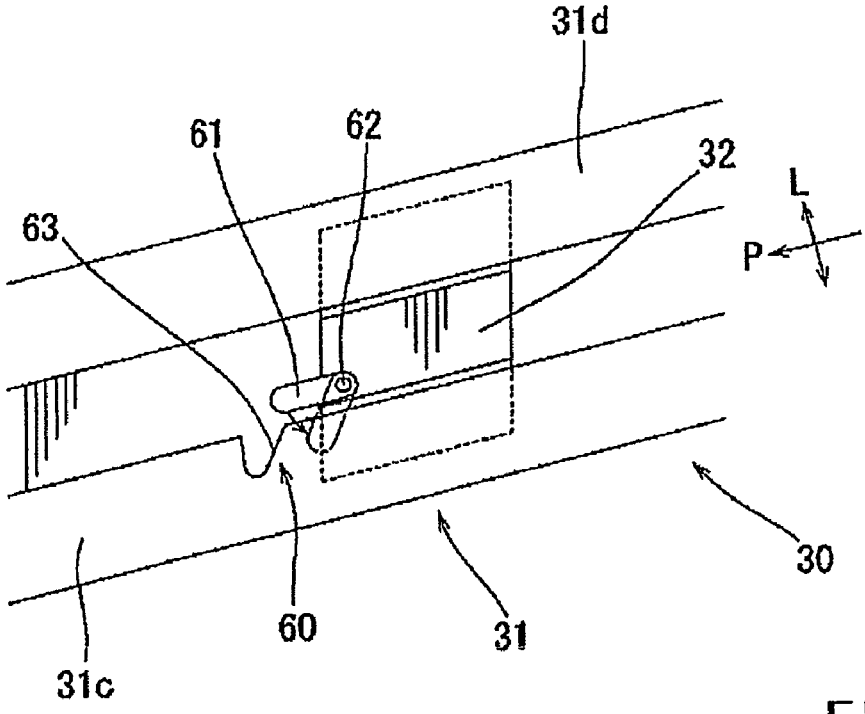
FIG. 6 is a schematic side view showing a pusher holding device of a magazine according to a third embodiment of the present invention.

A third embodiment of the present invention will now be described with reference to FIG. 6. A pusher holding device 60 according to this embodiment includes a stopper 61 mounted to the pusher 32. More specifically, the stopper 61 is pivotally mounted to a left side surface of the pusher 32 via a support shaft 62 and can pivot vertically (in the fastener height direction L) between a rest position indicated by solid lines and an engaging position indicated by chain lines. Also, the stopper 61 can be held at the rest position by a retainer projection (not shown) similar to the retainer projection 41*a* of the first embodiment and can contact a stopper projection (not shown) similar to the stopper projection 41*b*. A notch-like engaging recess 63 is formed in the guide rail 31*c* and is positioned at a midway position within the movable range of the pusher 32 in the fastener feeding direction P.

When the stopper 61 is pivoted to the engaging position, the stopper 51 can engage the engaging recess 63, so that the pusher 32 may be prevented from moving in the fastener feeding direction P.

Also with this arrangement, the pusher 32 can be easily held at the midway position within the movable range of the pusher 32. Therefore, it may be possible to move the pusher 32 by a relatively small force to the midway position to enable the operation for removing the clogged nail(s) within the fastener driving channel 4*b* to be effectively performed.

Fourth Embodiment

Figure 7:
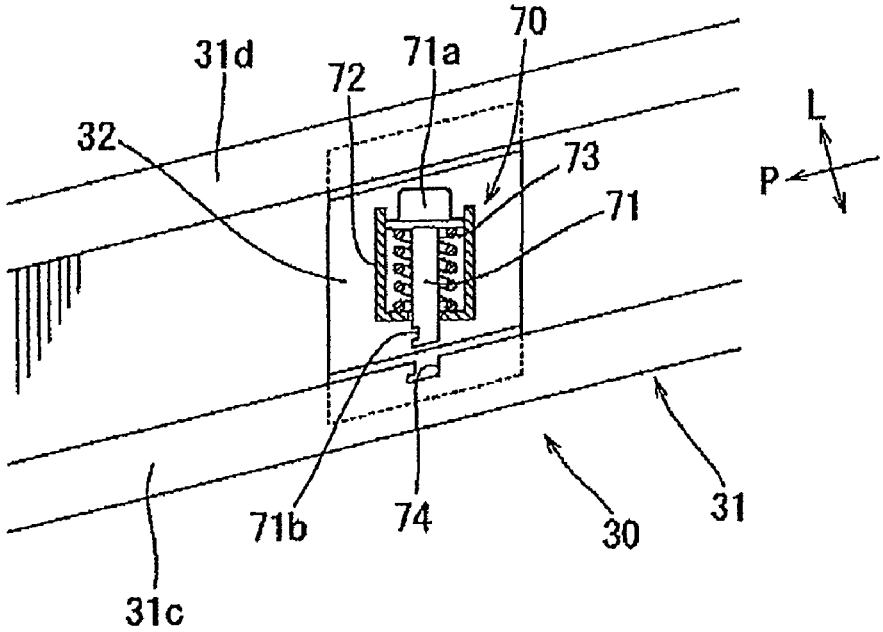
FIG. 7 is a schematic side view showing a pusher holding device of a magazine according to a fourth embodiment of the present invention.

A fourth embodiment of the present invention will now be described with reference to FIG. 7. A pusher holding device 70 according to this embodiment includes a stopper rod 71 serving as an engaging member. A rod holder 72 is mounted to a left side surface of the pusher 32 and supports the stopper rod 71, so that the support rod 71 can move in an axial direction parallel to the fastener height direction L. A push button 71*a* is provided on an upper end of the stopper rod 71, so that the operator can push the push button 71*a* for axially moving the stopper rod 71. A compression spring 73 is interleaved between the push button 71*a* and a bottom portion of the rod holder 72, so that the stopper rod 71 is biased upwardly (as viewed in FIG. 6) toward a rest position by the compression spring 73.

A hook portion 71*b* is formed on the lower end (as viewed in FIG. 7) of the stopper rod 71. The stopper rod 71 is prevented from rotating about its axis relative to the rod holder 72 by a rotation preventing projection (not shown). An L-shaped notch-like engaging recess 74 is formed in the guide rail 31*c* and has an open upper end. The engaging recess 74 is positioned at a midway position within the movable range of the pusher 32 in the fastener feeding direction P. When the operator pushes the push button 71*a* downward against the biasing force of the compression spring 73 on the condition that the pusher 32 is positioned at the midway position, the lower end of the support rod 71 can move into the engaging recess 74. When the operator releases the pusher 32, the hook portion 71*b* is engaged by the front edge of the engaging recess 74 due to the biasing force applied to the pusher 32. Therefore, the stopper rod 71 can be held at the engaging position. Because the stopper rod 71 is locked at the engaging position, the pusher 32 is held at the midway position within the movable range in the fastener feeding direction P.

In order to release the position holding condition of the pusher 32, the operator may move the pusher 32 rearward opposite to the fastener feeding direction P by a little distance, so that the hook portion 71*b* moves away from the front edge of the engaging recess 74. Then, the stopper rod 71 returns to the rest position by the biasing force of the compression spring 73. As a result, the position holding condition of the pusher 32 can be released.

Also with this pusher holding device 70, it is possible to hold the pusher 32 at the midway position in the fastener feeding direction by a simple operation.

Fifth Embodiment

Figure 8:
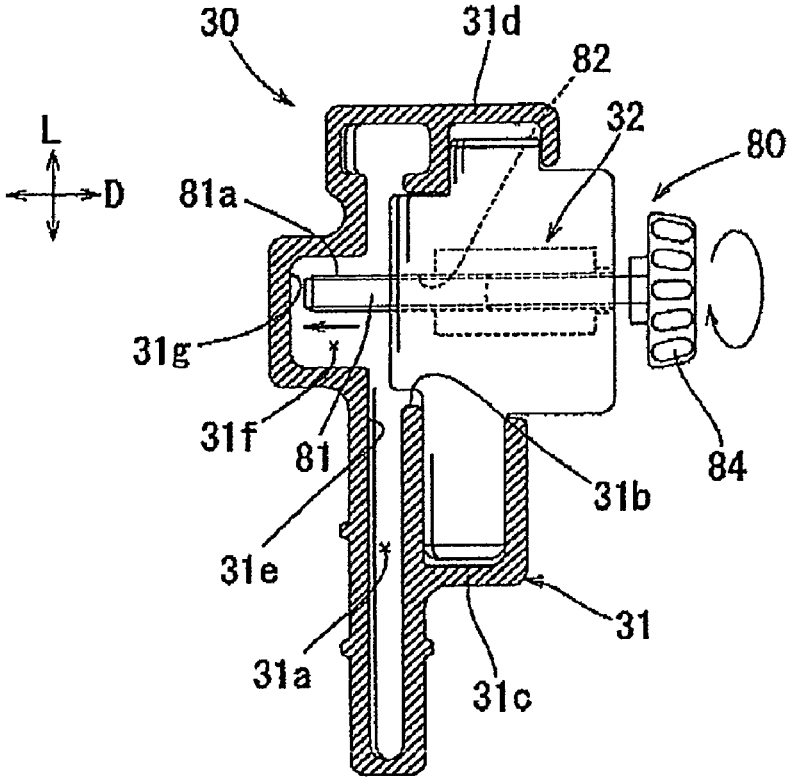
FIG. 8 is a schematic cross sectional view showing a pusher holding device of a magazine according to a fifth embodiment of the present invention.

A fifth embodiment according to the present invention will now be described with reference to FIG. 8. A pusher holding device 80 of this embodiment includes a stopper screw 81. The stopper screw 81 has a threaded shank 81*a* and a head having a grip 84 mounted thereto. The threaded shank 81*a* threadably engages a threaded hole 82 formed in the pusher 32 and extends throughout the thickness of the pusher 32 in the fastener thickness direction D. The grip 84 is positioned on one side of the pusher 32 and on the outer side of the magazine body 31, so that the operator can easily grasp the grip 84. When the operator grasps the grip 84 and rotates the stopper screw 81 in one direction (tightening direction), the stopper screw 81 moves in an axial direction (the fastener thickness direction D) to an engaging position, where an end portion of the threaded shank 81*a* abuts to the bottom 31*g* of the recess 31*f* of the magazine body 31. Thus, in the engaging position, the pusher 32 can be prevented from moving in the fastener feeding direction P due to the frictional force between the end portion of the threaded shank 81*a* and the bottom 31*g* of the recess 31*f*.

As the operator rotates the grip 84 in the opposite direction (loosening direction), the end portion of the threaded shank 81*a* moves away from the bottom 31*g* of the recess 31*f*, so that the stopper screw 81 moves from the engaging position to a rest position. Therefore, the pusher 32 can move in the fastener feeding direction P.

According to the pusher holding device 80 of this embodiment, the pusher 32 can be held at the midway position within the movable range in the fastener feeding direction P by tightening the stopper screw 81 to move it to the engaging position. In addition, it is possible to lock the pusher 32 in position by a simple rotational operation of the stopper screw 81.

Further, because the pusher 32 is locked by the abutment of the end portion of the threaded shank 81*a* to the bottom 31*g* of the magazine body 31, the operator can lock the pusher 32 at any position within the movable range of the pusher 32. Therefore, the operator can lock the pusher 32 at any desired position depending on the kind of work to be performed. As a result, it is possible to improve the operability of the magazine 30 and to improve the working efficiency.

The above pusher holding devices 40, 50, 60, 70 and 80 can still be modified in various ways. For example, the pusher holding device 40 may be modified such that the stopper 40 is mounted to the pusher 32 and can engage an engaging portion mounted to or formed on the guide rail 31*c* for holding the pusher 32 in the midway position. Similarly, the pusher holding device 50 may be modified such that the engaging member 51 is mounted to the pusher 32 and can engage an engaging portion mounted to or formed on the bottom of the magazine body 31. The push lock device 60 may be modified such that the stopper 61 is mounted to the guide rail 31*c* or 31*d* of the magazine body 31 and can engage an engaging recess formed in the pusher 32. The push lock device 70 may be modified such that the stopper rod 71 is supported on the magazine body 31 and the engaging recess 74 is formed in the pusher 32 for engagement with the stopper rod 71. The push lock device 80 may be modified such that the threaded shank 81*a* of the stopper screw 81 is threadably engaged with the bottom 31*g* or the guide rail 31*c* or 31*d* and can contact a part of the pusher 32 when the stopper screw 81 is tightened.

Further, in order to move the engaging member (or the stopper or the stopper rod) between the engaging position and the rest position, various moving mechanisms can be used other than those used in the first to fifth embodiments. In summary, the engaging member rotate, pivot, slide or axially move by a pushing operation or by means of a read mechanism.

Sixth Embodiment

Figure 9:
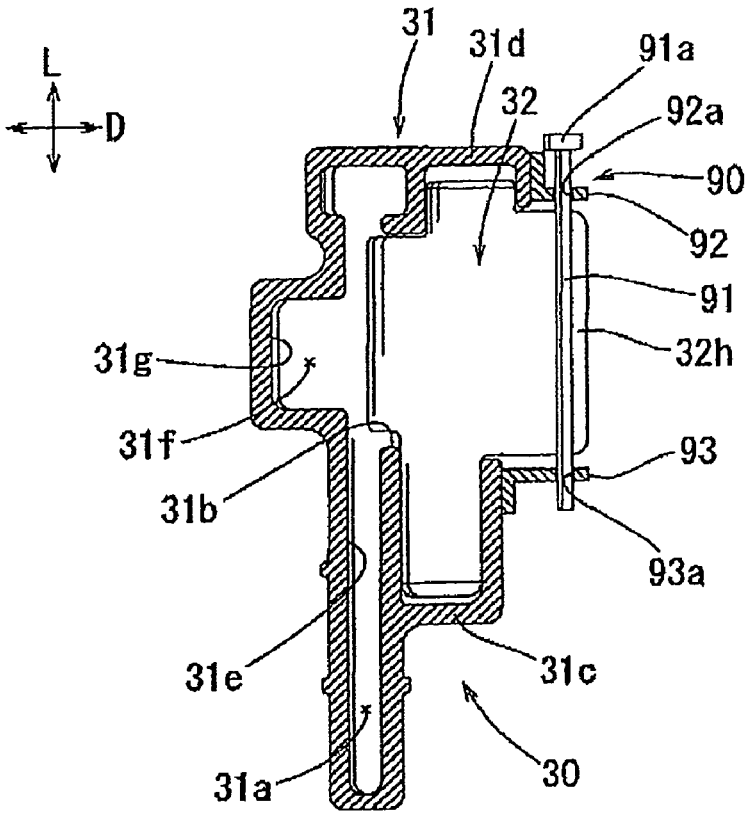
FIG. 9 is a schematic cross sectional view showing a pusher holding device of a magazine according to a sixth embodiment of the present invention.

A sixth embodiment will not be described with reference to FIG. 9. A pusher holding device 90 according to this embodiment includes a pair of L-shaped restricting brackets 92 and 93 attached to outer side walls of the guide rails 31*c* and 31*d* of the magazine body 31, respectively. The restricting brackets 92 and 93 are positioned at a midway position of the movable range in the fastener feeding direction P of the pusher 32 and arm opposed to each other. Restricting holes 92*a* and 93*a* are formed in the restricting brackets 92 and 93, respectively, and have the same diameter and the same axis. A restricting bar 91 can be inserted through the restricting holes 92*a* and 93*a* and has a flange portion 91*a* at its upper end. The flange portion 91*a* has a diameter larger than the diameter of the restricting holes 92*a* and 93*a*. Therefore, after the restricting bar 91 has been inserted through the restricting holes 92*a* and 93*a* from above in FIG. 9, the restricting bar 91 can be kept inserted through the restricting holes 92*a* and 93*a*. For example, the restricting bar 91 may be constituted by a nail having a suitable diameter and length.

As the restricting bar 91 is inserted through the restricting holes 92*a* and 93*a*, the restricting bar 91 extends between the restricting brackets 92 and 93. The pusher 32 has a protruding portion 32*h* protruding outward from the magazine body 31, so that the restricting bar 91 can contact the protruding portion 32*h* in order to prevent the pusher 32 from moving in the fastener feeding direction P. Therefore, the pusher 32 can be held at the midway position.

Removing the restricting bar 91 from the restricting holes 92*a* and 93*a* allows the pusher 32 to move in the fastener feeding direction P, so that the pusher 32 can perform the feeding operation of the fastener stick N.

Also with this embodiment, it is possible to hold the pusher 32 at the midway position within the movable range of the pusher 32. Although this embodiment utilizes the restricting bar 91 that is a separated member from the magazine body 31, the restricting bar 91 can contact the protruding portion 32*h* of the pusher 32, which protrudes outward from the magazine body 31 beyond the guide rails 31*c* and 31*d* and is positioned away from the feeding claw 32*a*. Therefore, it is possible to reliably prevent the feeding claw 32 or its proximate portion from being deformed or damaged. As a result, it is possible to improve the durability of the magazine 30.

Seventh Embodiment

Figure 10:
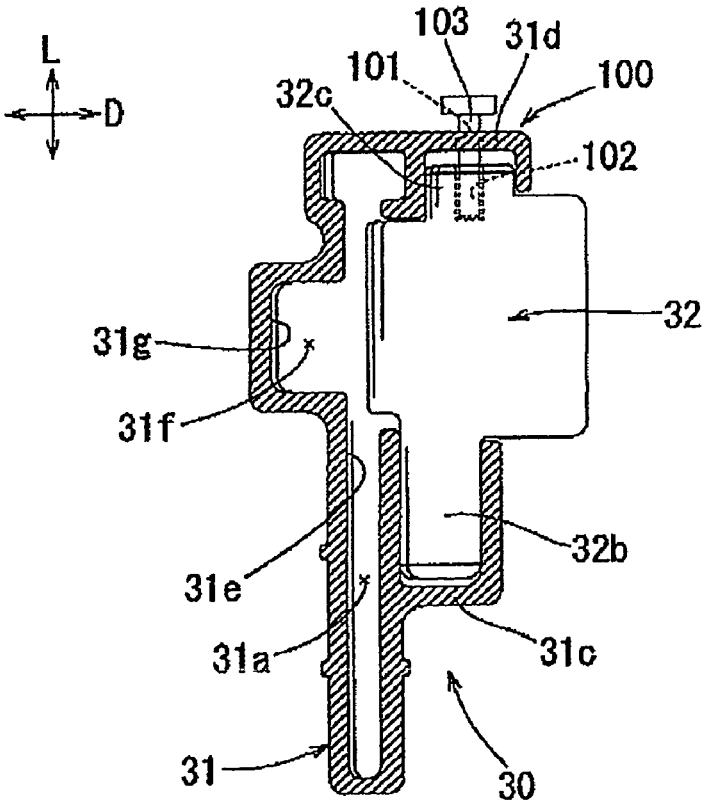
FIG. 10 is a schematic cross sectional view showing a pusher holding device of a magazine according to a seventh embodiment of the present invention.

A seventh embodiment will now be described with reference to FIG. 10. A pusher holding device 100 of this embodiment includes a lock hole 101 formed in an upper wall as viewed in FIG. 10 of the guide rail 31*d* and extending throughout the thickness of the upper wall, an engaging hole 102 formed in the upper portion of the upper guide portion 32*c* of the pusher 32, and a lock pin 103 that can be inserted into the lock hole 101 and further into the engaging hole 102. With this arrangement, it is also possible to lock the pusher 32 at a midway position within the movable range in the fastener feeding direction P of the pusher 32. Further, similar to the sixth embodiment, the lock pin 103 may be positioned away from the feeding claw 32*a* or its proximate portion. Therefore, it is possible to improve the durability of the magazine 30.

Eighth Embodiment

Figure 11:
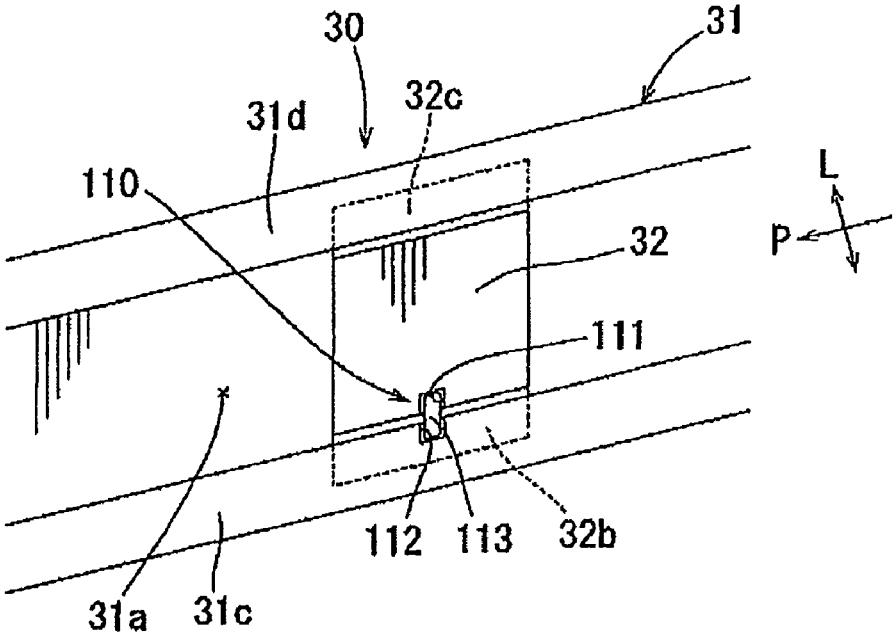
FIG. 11 is a schematic side view showing a pusher holding device of a magazine according to an eighth embodiment of the present invention.

An eighth embodiment will now be described with reference to FIG. 11. A pusher holding device 110 according to this embodiment includes a rectangular recess 111 formed in a lower portion of on the left side of the pusher 32, and a rectangular recess 112 formed in the lower guide rail 31*e* at a midway position within the movable range in the feeding direction P of the pusher 32. The rectangular recess 112 can oppose to the rectangular recess 111 when the pusher 32 is positioned at the midway position. The pusher holding device 110 further includes a rectangular lock member 113 that can be inserted into the rectangular recesses 111 and 112 to extend therebetween when the pusher 32 is positioned at the midway position. Therefore, the pusher 32 can be locked at the midway position. The rectangular recesses 111 and 112 may be replaced with semi-cylindrical recesses. In such a case, the rectangular lock member 113 may be replaced with a semi-cylindrical lock member.

Ninth Embodiment

Figure 12:
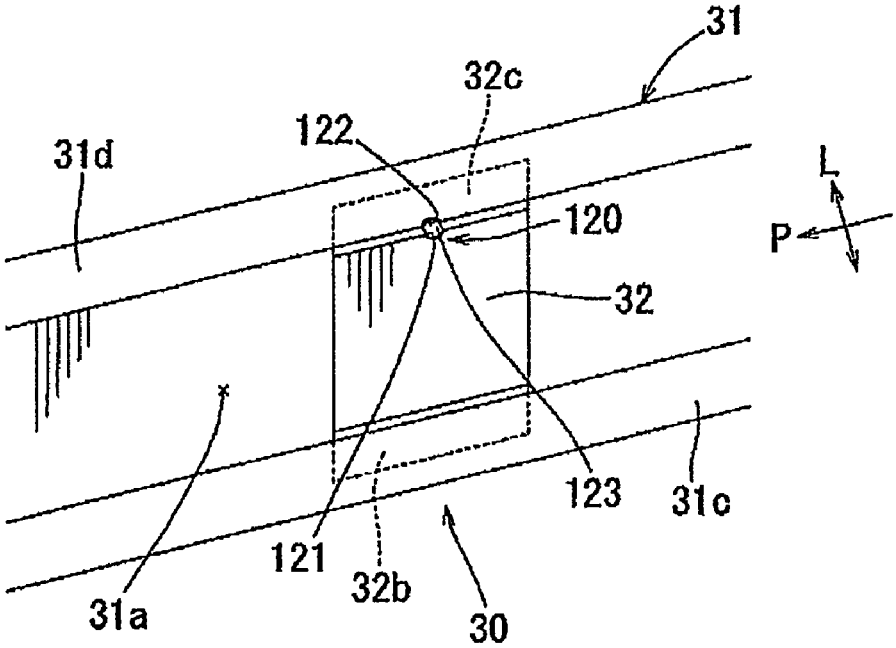
FIG. 12 is a schematic side view showing a pusher holding device of a magazine according to a ninth embodiment of the present invention.

A ninth embodiment will now be described with reference to FIG. 12. A pusher holding device 120 according to this embodiment includes a semicircular recess 121 formed in an upper portion of the left side of the pusher 32, and a semicircular recess 122 formed in the upper guide rail 31*d* at a midway position within the movable range in the feeding direction P of the pusher 32. The semicircular recess 122 can oppose to the semicircular recess 121 when the pusher 32 is positioned at the midway position. The pusher holding device 120 further includes a circular lock member 123 that can be inserted into the semicircular recesses 121 and 122 to extend therebetween when the pusher 32 is positioned at the midway position. Therefore, the pusher 32 can be locked at the midway position. The semicircular messes 121 and 122 may be replaced with quadrant spherical recesses. In such a case, the circular lock member 123 may be replaced with a hemispherical member.

Also with the arrangement of the seventh and ninth embodiments, the rectangular recess 111 and the semicircular recess 121 are positioned away from the feeding claw 32*a* and its proximate portion. Therefore, it is possible to improve the durability of the magazine 30.

In summary, according to the sixth to ninth embodiments, the engaging member (i.e., the restricting bar 91, the lock pin 103, the rectangular lock member 113 or the circular lock member 112) engages the pusher 32 without entering the fastener receiving space 31*a* (or without extending across the fastener receiving space 31*a*). This arrangement may prevent the feeding claw 32*a* and its proximate portion from being damaged by the engaging member. Therefore, it is possible to ensure that the fasteners can be reliably fed during the long time use of the magazine 30. As a result, it is possible to improve the durability of the pusher 32 and the magazine 30.

Tenth Embodiment

Figure 13:
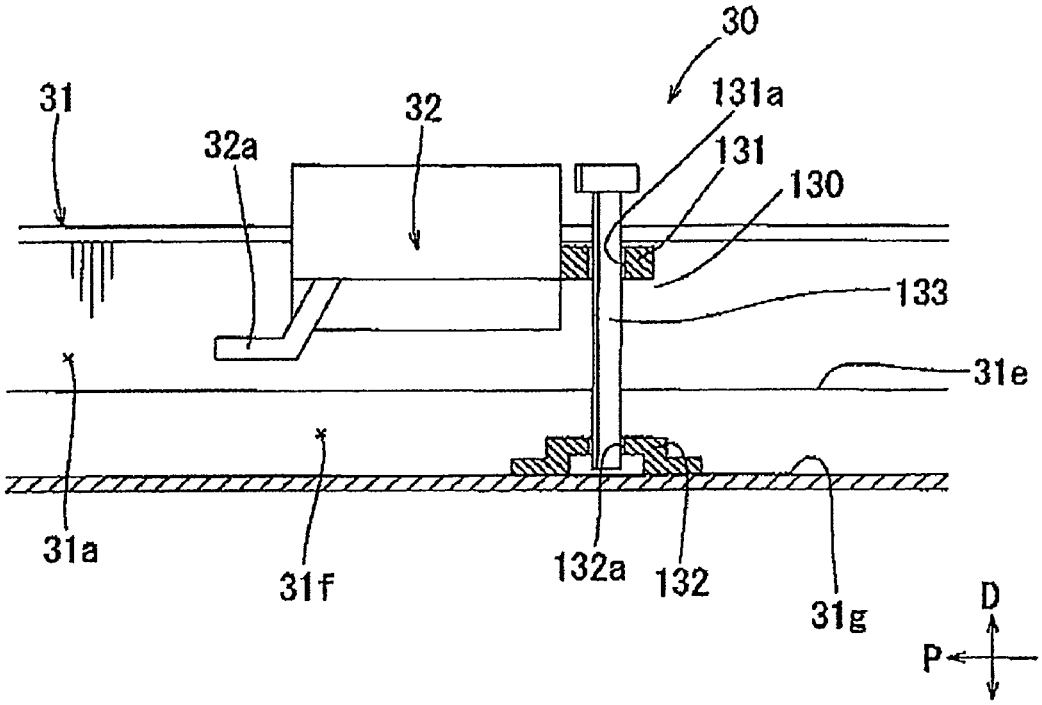
FIG. 13 is a schematic cross sectional view showing a pusher holding device of a magazine according to a tenth embodiment of the present invention.

A tenth embodiment will now be described with reference to FIG. 13. A pusher holding device 130 of this embodiment includes a first bracket 131 mounted to the rear end of the pusher 32, a second bracket 132 mounted to the bottom 31*g* of the magazine body 31, and a lock pin 133 that can be inserted into the first and second brackets 131 and 132 to extend therebetween. More specifically, a support hole 131*a* and an engaging hole 132*a* are formed in the first bracket 131 and the second bracket 132, respectively, and have the same diameter. The lock pin 133 can be inserted through the support hole 131*a* and the engaging hole 132*a*.

When the pusher 32 is positioned at a midway position within the movable range in the fastener feeding direction P, the support hole 131*a* and the engaging hole 132*a* are positioned to be aligned with each other on the same axis that extends in the fastener thickness direction D. Then, the lock pin 133 is inserted through the support hole 131*a* and the engaging hole 132*a*, so that the pusher 32 can be locked at the midway position. Removing the lock pin 133 from the support hole 131*a* and the engaging hole 132*a* allows the pusher 32 to move toward the fastener driving channel 4*b*.

Although the support hole 131*a* is formed in the first bracket 131 that is mounted to the pusher 32, the support hole 131*a* may be formed directly in the rear portion of the pusher 32. In such a case, the first bracket 131 can be omitted.

Eleventh Embodiment

Figure 14:
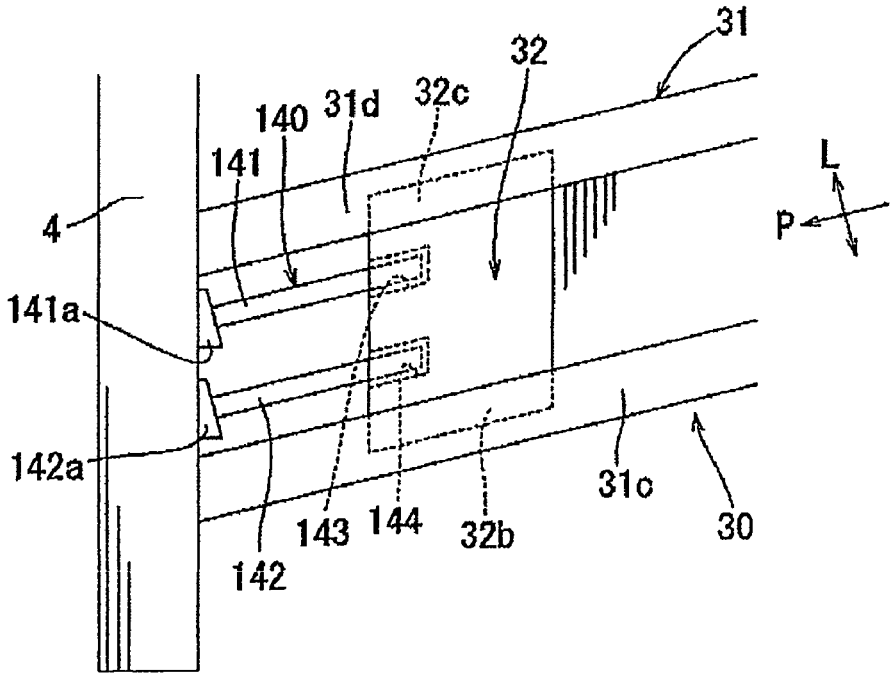
FIG. 14 is a schematic side view showing a pusher holding device of a magazine according to an eleventh embodiment of the present invention.

An eleventh embodiment will now be described with reference to FIG. 14. A pusher holding device 140 of this embodiment includes two lock pins 141 and 142 and further includes two parallel support holes 143 and 144 formed in the front portion of the pusher 32. The support holes 143 and 144 have bottoms and have axes parallel to the fastener feeding direction P.

In order to lock the pusher 32 at a midway position within the movable range in the fastener feeding direction P, the operator moves the pusher 32 to the midway position and then he or she inserts the lock pins 141 and 142 into the support holes 143 and 144, respectively, so that the rear ends of the lock pins 141 and 142 are received within the support holes 143 and 144, respectively. Therefore, the lock pins 141 and 142 extend forwardly from the front surface of the pusher 32. Thereafter, the operator releases the pusher 32, so that flange portions 141*a* and 142*a* formed on the front ends of the lock pins 141 and 142 contact a rear surface of the driver guide 4. Hence, the pusher 32 can be held at the midway position. In this way, the lock pins 141 and 142 serve as prop bars for holding the pusher 32 at the midway position. Because the lock pins 141 and 142 are positioned away from the feeding claw 32*a* of the pusher 32, it is possible to prevent the feeding claw 23*a* and its proximate portion from being damaged by the lock pins 141 and 142, so that the durability of the magazine 30 can be improved.

Twelfth Embodiment

Figure 15:
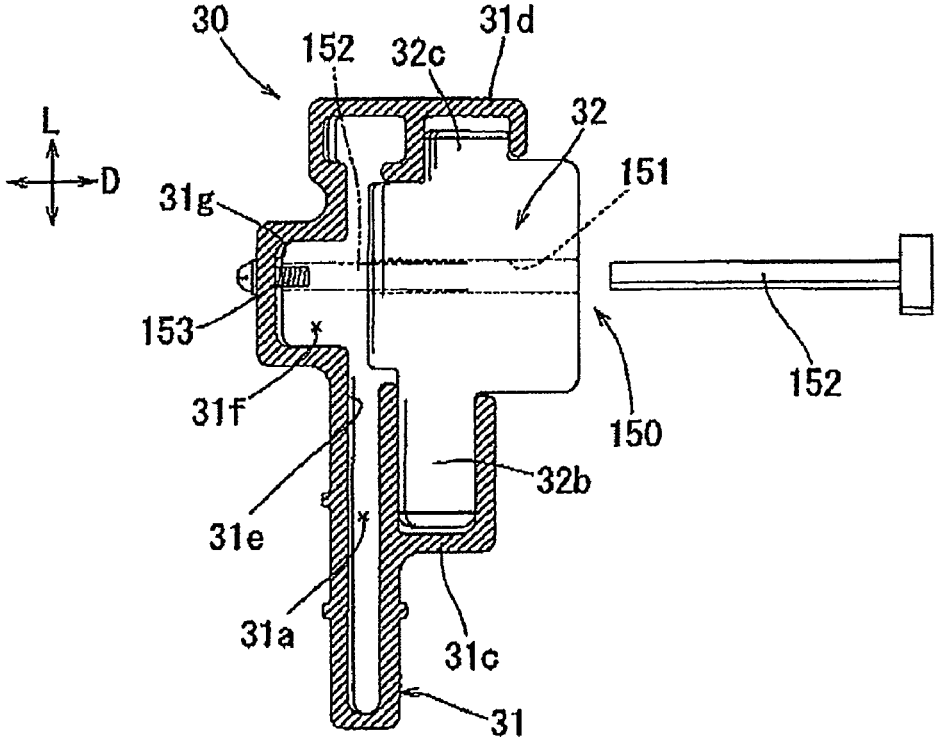
FIG. 15 is a schematic cross sectional view showing a pusher holding device of a magazine according to a twelfth embodiment of the present invention.

A twelfth embodiment will now be described with reference to FIG. 15. A pusher holding device 150 of this embodiment includes a lock pin 152 that can be inserted into a support hole 151 formed in the pusher 32 to extend therethrough. The support hole 151 is formed to extend from one side (right side as viewed in FIG. 15) to the other side (left side as viewed in FIG. 15) of the pusher 32 in the fastener thickness direction D. When the lock pin 152 has been completely inserted into the support hole 151, the end portion (left end as viewed in FIG. 15) of the lock pin 152 may be positioned proximal to the bottom 31*g* of the magazine body 31 but does contact the bottom 31*g*. The pusher holding device 150 of this embodiment further includes a stopper screw 153 engaged with a corresponding threaded hole formed in the bottom 31*g*. The stopper screw 153 has an axis that is parallel to the fastener thickness direction D and is aligned with the support hole 151 when the pusher 32 is positioned at the midway position within its movable range in the fastener feeding direction P. An end portion of the stopper screw 153 extends into the recess 31*f* but does not enter the fastener receiving space 31*a*, so that the stopper screw 153 does not interact with the fastener stick N.

In order to hold the pusher 32 at the midway position, the operator moves the pusher 32 to a position adjacent to and rearward of the stopper screw 153 with respect to the fastener feeding direction P. Then, with the pusher 32 held in this position, the operator inserts the lock pin 152 into the support hole 151, so that the end portion of the lock pin 152 extends into the recess 31*f* as indicated by chain lines in FIG. 15. Thereafter, the operator releases the pusher 32 or moves the pusher 32 forwardly, so that the end portion of the lock pin 152 contacts the stopper screw 153 to prevent further movement of the pusher 32 in the fastener feeding direction P. Hence, the pusher 32 can be held in the midway position.

Also with this arrangement, it is possible to prevent the feeding claw 23*a* and its proximate portion from being damaged by the lock pin 152, so that the durability of the magazine 30 can be improved.

In summary, according to the tenth to twelfth embodiments, the lock pin (133, 141(142), or 152) is inserted into the support hole (131*a*, 143(144) or 151) formed in the pusher 32 and serving to support the lock pin, and the lock pin engages or contacts with the magazine body 30 or the driver guide 4 in order to hold the pusher 32 at the midway position.

Thirteenth Embodiment

Figure 16:
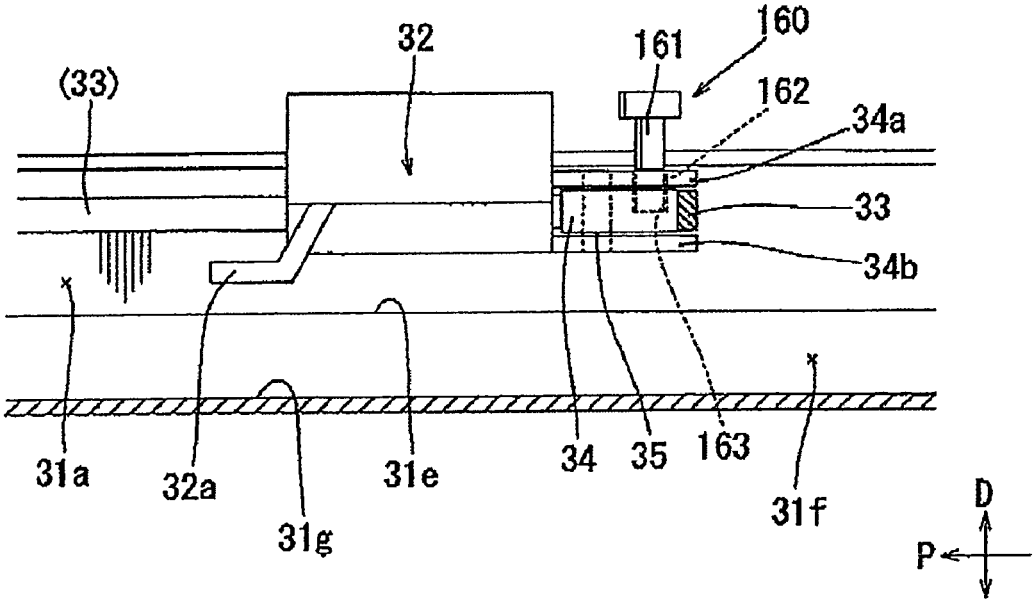
FIG. 16 is a schematic cross sectional view showing a pusher holding device of a magazine according to a thirteenth embodiment of the present invention.

A thirteenth embodiment of the present invention will now be described with reference to FIG. 16. A pusher holding device 160 of this embodiment is configured to restrict the deformation of the leaf spring 33 that serves to bias the pusher 32 in the fastener feeding direction P.

As described in connection with the first embodiment, the leaf spring 33 is wound around the winding wheel 34 that is rotatably supported between a pair of the support wall portions 34*a* and 34*b* via the support shaft 35. An insertion hole 162 is formed in the support wall portion 34*a* positioned on the upper side as viewed in FIG. 16 and extends through the upper wall portion 34*a* in the fastener thickness direction D.

The winding side end portion of the leaf spring 33 is secured to the winding wheel 34 and the unwinding side end portion 33*a* of the leaf spring 33 is secured to the front end with respect to the fastener feeding direction P of the magazine body 31. Therefore, as the pusher 32 moves toward the fastener feeding direction P, the distance between the pusher 32 and the unwinding side end portion 33*a* secured to the front end portion of the magazine body 31 decreases, so that the winding side portion of the leaf spring 33 is wound around the winding wheel 34. In this way, the winding wheel 34 rotates in one direction as the leaf spring 33 is wound around the winding wheel 34, while the winding wheel 34 rotates in an opposite direction as the leaf spring 33 is unwound from the winding wheel 34. Therefore, the movement of the pusher 32 and the movement of the leaf spring 33 as well as the rotational movement of the winding wheel 34 are correlated with each other.

According to this embodiment, a bottomed engaging hole 163 is formed in a surface of the winding wheel 34, which is opposed to the support wall portion 34*a*. The engaging hole 163 has the same diameter as the insertion hole 162 and can align with the insertion hole 162 as the winding wheel 34 rotates. More specifically, when the pusher 32 has moved to a midway position within the movable range in the fastener feeding direction P, the engaging hole 163 is positioned to align with the insertion hole 162. With the pusher 32 held in this position, a lock pin 161 can be inserted into the insertion hole 162 and further into the engaging hole 163, so that the winding wheel 34 can be fixed with respect to the rotational movement. Therefore, the pusher 32 can be fixed in the midway position. Removing the lock pin 161 from the engaging hole 163 allows the pusher 32 to move in the fastener feeding direction P.

Because the winding wheel 34 is positioned away from the fastener feeding claw 32*a*, it is possible to prevent the feeding claw 23*a* and its proximate portion from being damaged by the lock pin 161, so that the durability of the magazine 30 can be improved.

In summary, the thirteenth embodiment is different from the previously described embodiments in that the pusher 32 is indirectly looked at the midway position by restricting the rotation of the winding wheel 34 of the leaf spring 33 that biases the pusher 32 in the fastener feeding direction P.

The thirteenth embodiment can be modified in various ways. For example, although only one engaging hole 163 is formed in the winding wheel 34, a plurality of engaging holes may be formed in the winding wheel 34 so as to be spaced from each other in the rotational direction of the winding wheel 34, so that it is possible to lock the pusher 32 at a plurality of different midway positions to enable selection of one of the midway positions depending on the work to be performed. Therefore, it is possible to further efficiently perform the work relating to the magazine 30.

This invention claims:

1. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a biasing device constructed to bias the pusher in the fastener feeding direction; and a pusher holding device configured to hold the pusher at a midway position within a movable range of the pusher in the fastener feeding direction, the pusher holding device comprising:

a manually operable engaging member mounted to one of the magazine body and the pusher and movable between an engaging position and a rest position, wherein:

the engaging member can engage the other of the magazine body and the pusher for holding the pusher at the midway position against the biasing force of the biasing device, and the engaging member is configured to hold the pusher at the midway position independently of the position of the fasteners positioned in the fastener feeding direction relative to the pusher.

2. The magazine as in claim 1, wherein the engaging member can pivot relative to the one of the magazine and the pusher.

3. The magazine as in claim 2, wherein the engaging member can pivot within a plane parallel to the fastener feeding direction.

4. The magazine as in claim 2, wherein the engaging member comprises a leaf spring.

5. The magazine as in claim 1, wherein:

the magazine body includes a pair of guide rails configured to guide the fasteners along the fastener feeding direction; and the engaging member is mounted to one of the guide rails.

6. The magazine as in claim 1, wherein:

the magazine body includes a pair of guide rails configured to guide the fasteners in the fastener feeding direction; and the engaging member is mounted to the pusher and can engage one of the guide rails.

7. The magazine as in claim 1, wherein the engaging member can move in a direction perpendicular to the fastener feeding direction.

8. The magazine as in claim 7, wherein:

the fasteners are joined parallel to each other to form a fastener stick having a lengthwise direction, a height direction and a thickness direction that are perpendicular relative to each other;

the fastener stick is stored within the magazine such that the lengthwise direction of the fastener stick is parallel to the fastener feeding direction; and the engaging member can move in one of the height direction and the thickness direction.

9. The magazine as in claim 8, wherein the engaging member can move in the height direction and is biased in one of engaging and disengaging directions.

10. The magazine as in claim 8, wherein:

the magazine body has a recess formed therein and communicating with the fastener receiving space;

the recess has a bottom positioned away from the fastener receiving space in the thickness direction; and the engaging member extends through the pusher in the thickness direction and is threadably engaged with the pusher, so that one end of the engaging member can frictionally contact with the bottom of the recess.

11. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a biasing device constructed to bias the pusher in the fastener feeding direction;

a pair of guide rails configured to guide the fasteners in the fastener feeding direction; and a pusher holding device configured to hold the pusher at a midway position within a movable range of the pusher in the fastener feeding direction, the pusher holding device comprising:

an engaging member mounted to one of the pusher and the guide rail, the engaging member being configured to engage the other of the pusher and the guide rails.

12. The magazine as in claim 11, wherein the engaging member comprises a restricting bar that is removably mounted between the guide rails and can contact with one end of the pusher in the fastener feeding direction.

13. The magazine as in claim 11, wherein:

the engaging member comprises a pin; and the pusher holding device further comprises an engaging hole formed in the pusher and an insertion hole formed in one of the guide rails, so that the pin can be inserted into the engaging hole formed in the pusher through the insertion hole formed in one of the guide rails.

14. The magazine as in claim 11, wherein:

the pusher holding device further comprises a first recess formed in the pusher and a second recess formed in one of the guide rails, and the engaging member can be inserted into the first and second recesses to extend therebetween.

15. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a biasing device constructed to bias the pusher in the fastener feeding direction; and a pusher holding device configured to hold the pusher at a midway position within a movable range of the pusher in the fastener feeding direction, the pusher holding device comprising:

an insertion hole formed in the pusher; and an engaging member that can be removably inserted into the insertion hole;

an engaging portion provided on the magazine body or a part of the tool body, so that the engaging member can engage the engaging portion, wherein:

the magazine body has a recess formed therein and communicating with the fastener receiving space;

the recess has a bottom positioned away from the fastener receiving space;

the engaging portion comprises a part of the bottom; and the engaging member comprises a manually operable pin that can be manually inserted into and removed from the recess.

16. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a biasing device constructed to bias the pusher in the fastener feeding direction; and a pusher holding device configured to hold the pusher at a midway position within a movable range of the pusher in the fastener feeding direction, the pusher holding device comprising:

an insertion hole formed in the pusher; and an engaging member that can be removably inserted into the insertion hole;

an engaging portion provided on the magazine body or a part of the tool body, so that the engaging member can engage the engaging portion, wherein:

the insertion hole is a bottomed hole formed in a front portion of the pusher in a direction parallel to the fastener feeding direction; and the fastener driving channel is defined within a driver guide that is a part of the tool body; and the engaging portion is disposed on the driver guide.

17. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a biasing device constructed to bias the pusher in the fastener feeding direction; and a pusher holding device configured to hold the pusher at a midway position within a movable range of the pusher in the fastener feeding direction, the pusher holding device comprising:

an insertion hole formed in the pusher; and an engaging member that can be removably inserted into the insertion hole;

an engaging portion provided on the magazine body or a part of the tool body, so that the engaging member can engage the engaging portion, wherein:

the magazine body has a recess formed therein and communicating with the fastener receiving space;

the recess has a bottom positioned away from the fastener receiving space;

the insertion hole is a through hole formed in the pusher;

the engaging portion comprises a projecting member mounted to the bottom, so that the engaging member can contact the projecting member in the fastener feeding direction when the engaging member is inserted into the insertion hole; and the engaging member comprises a manually operable pin that can be manually inserted into and removed from the insertion hole.

18. A magazine in a fastener driving tool, comprising:

a magazine body defining a fastener receiving space for storing a plurality of fasteners therein;

a pusher movable relative to the magazine body along a fastener feeding direction toward a fastener driving channel defined in a tool body of the fastener driving tool;

a leaf spring having a first end portion connected to the magazine body and a second end portion opposite to the first end;

a winding wheel rotatably supported on a support wall of the pusher;

wherein the second end portion of the leaf spring is connected to the winding wheel and is spirally wound around the winding wheel, so that the pusher is biased in the fastener feeding direction by the leaf spring; and a pusher holding device configured to hold the pusher at a midway position within a movable range of the pusher in the fastener feeding direction;

wherein the pusher holding device is configured to releasably fix the rotational position of the winding wheel relative to the support wall of the pusher.

19. The magazine as in claim 18, wherein the pusher holding device comprises:

a pin;

a first insertion hole formed in the support wall of the pusher; and a second insertion hole formed in the winding wheel, wherein the pin can be inserted into the second insertion hole through the first insertion hole.

20. The magazine as in claim 18, wherein the pusher holding device comprises a manually operable pin.

* * * * *